US007424862B1

(12) United States Patent
Wagner

(10) Patent No.: US 7,424,862 B1
(45) Date of Patent: Sep. 16, 2008

(54) REMOVABLE AND/OR COLLAPSIBLE SUNSHADE

(76) Inventor: Bruce Wagner, 31317 St. Margaret St., St. Clair Shores, MI (US) 48082

( * ) Notice: Subject to any disclaimer, the term of this patent is extended or adjusted under 35 U.S.C. 154(b) by 0 days.

(21) Appl. No.: 11/717,839

(22) Filed: Mar. 14, 2007

Related U.S. Application Data

(60) Provisional application No. 60/867,631, filed on Nov. 29, 2006.

(51) Int. Cl.
*B63B 17/00* (2006.01)

(52) U.S. Cl. ..... 114/361; 114/364

(58) Field of Classification Search ..... 114/343, 114/361, 364; 135/88.01; 280/414.1, 414.2
See application file for complete search history.

(56) References Cited

U.S. PATENT DOCUMENTS

| | | | | |
|---|---|---|---|---|
| 2,453,422 | A * | 11/1948 | Ellsworth | 114/361 |
| 2,505,520 | A | 4/1950 | Bills | |
| 2,821,989 | A | 2/1958 | Shepard | |
| 2,829,660 | A * | 4/1958 | Wester et al. | 114/361 |
| 2,833,296 | A * | 5/1958 | Woodruff, Sr. | 114/361 |
| 4,683,900 | A * | 8/1987 | Carmichael | 135/88.01 |
| 5,579,797 | A | 12/1996 | Rogers | 135/90 |
| 5,697,320 | A | 12/1997 | Murray | 114/361 |
| 5,904,114 | A | 5/1999 | Wright | 114/361 |
| 5,918,613 | A | 7/1999 | Larson | 135/88.01 |
| 5,931,114 | A * | 8/1999 | Bartholomew | 114/361 |
| 6,257,261 | B1 * | 7/2001 | Johnson | 114/361 |
| 6,615,762 | B1 | 9/2003 | Scott | 114/353 |
| 6,623,322 | B1 | 9/2003 | Lesniak | 441/38 |
| 6,672,241 | B2 | 1/2004 | Warfel et al. | 114/361 |
| 6,725,871 | B1 | 4/2004 | Shearer et al. | 135/88.01 |
| 6,968,800 | B1 * | 11/2005 | Becht | 114/361 |
| 7,032,532 | B2 | 4/2006 | Brooks et al. | 114/361 |
| 7,107,926 | B2 | 9/2006 | Fishburn | 114/361 |
| 7,111,578 | B2 | 9/2006 | Brooks et al. | 114/361 |

* cited by examiner

*Primary Examiner*—Lars A Olson
(74) *Attorney, Agent, or Firm*—Christopher P. Maiorana, PC

(57) ABSTRACT

An apparatus comprising a first pivot, a second pivot, a first pole, a second pole and a fabric portion. The first pivot may have a first insert and a second insert. The second pivot may have a third insert and a fourth insert. The first pole may have a first end connected to one of the first or second inserts and a second end connected to one of the third or fourth inserts. The second pole may have a first end connected to the other of the first or second inserts and a second end connected to the other of the third or fourth inserts. The poles may be arranged to create a gap between the first and second pivots. The fabric portion may be connected between the poles to cover the gap.

9 Claims, 7 Drawing Sheets

REMOVABLE AND/OR COLLAPSIBLE SUNSHADE

This application claims the benefit of U.S. Provisional Application No. 60/867,631 filed Nov. 29, 2006 and is hereby incorporated by reference in its entirety.

FIELD OF THE INVENTION

The present invention relates to boat shades generally and, more particularly, to a method and/or apparatus for implementing a removable and/or collapsible sunshade.

BACKGROUND OF THE INVENTION

Conventional boat sunshades, such as bimini tops, that are available in commercial markets are often designed for large boats. Such shades typically have large and cumbersome aluminum frames. Such frames do not disassemble easily and only allow for permanent mounting. A permanently mounted frame does not work well on smaller boats, such as inflatable boats or hard shell rowboats.

It would be desirable to implement a sunshade for a boat that would allow a consumer to bring along the sunshade in the boat and assemble the sunshade when needed. It would also be desirable to implement a sunshade that swivels down and out of the way of passengers without needing to be detached from a boat.

SUMMARY OF THE INVENTION

The present invention concerns an apparatus comprising a first pivot, a second pivot, a first pole, a second pole and a fabric portion. The first pivot may have a first insert and a second insert. The second pivot may have a third insert and a fourth insert. The first pole may have a first end connected to one of the first or second inserts and a second end connected to one of the third or fourth inserts. The second pole may have a first end connected to the other of the first or second inserts and a second end connected to the other of the third or fourth inserts. The poles may be arranged to create a gap between the first and second pivots. The fabric portion may be connected between the poles to cover the gap.

The objects, features and advantages of the present invention include providing a removable sunshade for a boat that may (i) be disassembled while either in the boat or out of the boat, (ii) be stored in a bag, and/or (iii) be used in a small boat, such as an inflatable or hard shell rowboat.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention concerns a sunshade or bimini top for a portable boat, such as an inflatable boat. The present invention may have two collapsible poles that normally fold down along with a fabric top to fit into a small waterproof bag. The present invention may be used to protect a consumer from harmful ultra violet (UV) rays by providing shading from direct sunlight. The present invention may be particularly useful in inflatable and aluminum portable type boats. The sunshade may be disassembled in the boat or out of the boat and may be stowed away in a small bag for easy convenience.

Figure 1:
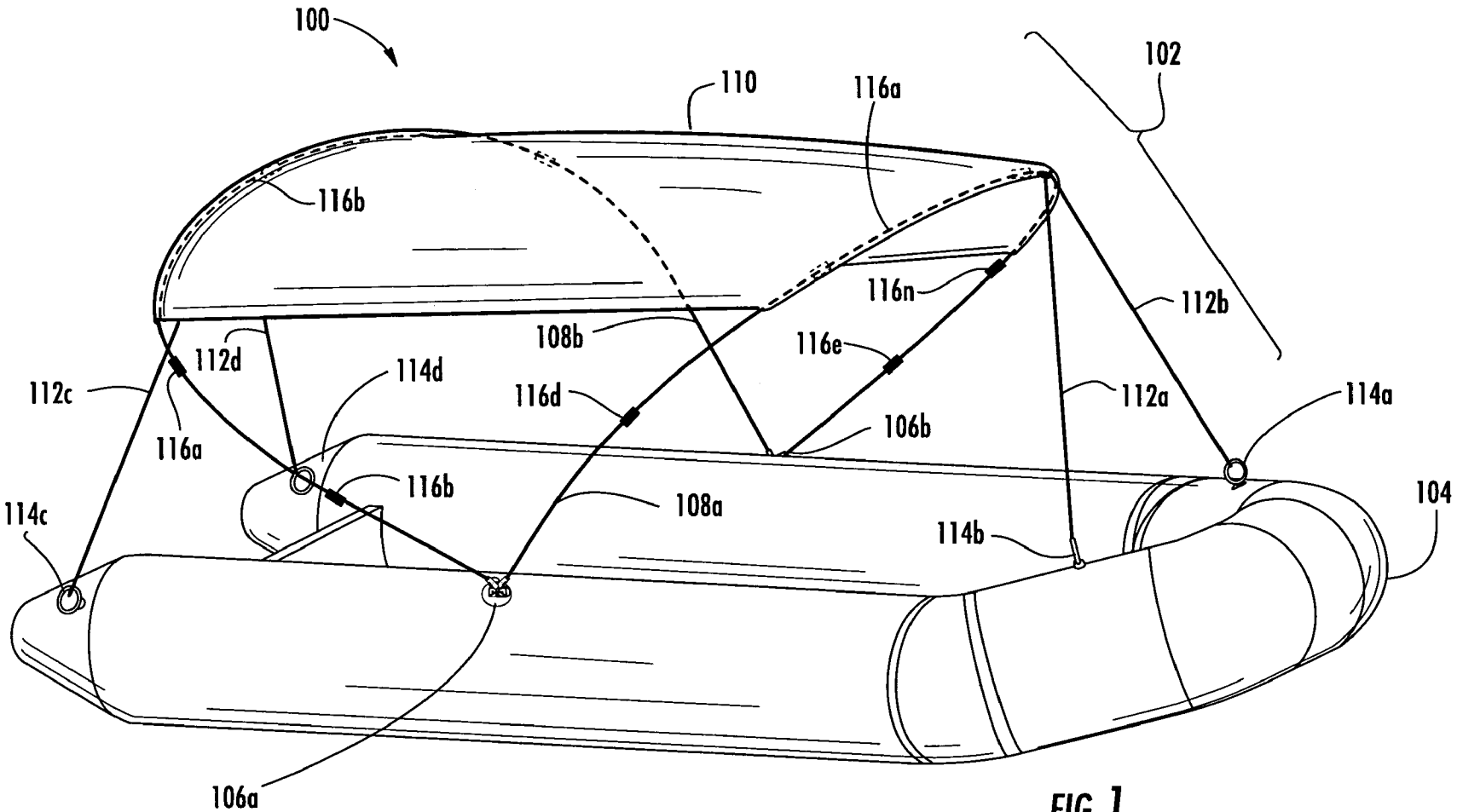
FIG. 1 is a perspective right side view of the sunshade.

Referring to FIG. 1, a diagram of a system 100 is shown in accordance with a preferred embodiment of the present invention. The system 100 generally comprises a cover (or sunshade) 102 connected to a boat 104. The cover 102 generally comprises a number of pivots 106*a* and 106*b*, a number of poles 108*a* and 108*b*, a fabric portion 110, a number of straps 112*a*-112*d*, and a number of rings 114*a*-114*d*. In one example, the poles 108*a*-108*b* may be made of fiberglass. However, other materials may be used accordingly to meet the design criteria of a particular implementation. In general, the poles 108*a*-108*b* are made from a light material that is flexible enough to bend, yet sturdy enough not to break. In one example, the poles 108*a* and 108*b* may each be made as a single piece. In another example, the poles 108*a*-108*b* may be made as a number of smaller sections connected by a number of ferrules 116*a*-116*n*. The ferrules 116*a*-116*n* may be implemented, in one example, as aluminum pieces configured to hold together the various sections of the poles 108*a*-108*b*.

The poles 108*a* and 108*b* normally slide through a channel 116*a* (or 116*b*) sewn into the fabric portion 110. While the channels 116*a*-116*b* are shown along the length of each side of the fabric portion 110, one or more smaller channels may be formed for each of the channels 116*a*-116*b*. For example, a small channel may be implemented periodically (e.g., every inch, every 3 inches, etc.) to hold the poles 108*a*-108*b*. Each end of the poles 108*a* and 108*b* may be secured to the pivots 106*a*-106*b*. For example, the pole 108*a* has a first end connected to one of a first or second inserts in the pivot 106*a* and a second end connected to one of a third or fourth insert in the pivot 106*b*. The pole 108*b* has a first end connected to the other of the first or second inserts of the pivot 106*a* and a second end connected to the other of the third or fourth inserts of the pivot 106*b*.

The pivots 106*a* and 106*b* may be attached to the boat 104. In one example, the pivots 106*a*-106*b* may be glued to the boat 104. However, the pivots 106*a* and 106*b* may be secured in other ways (e.g., with hook and loop fasteners, such as Velcro™, with snap hooks, etc.).

The straps 112*a*-112*n* may be adjustable. The straps 112*a*-112*n* may be made of nylon, or another type of strong, yet light weight material. In one example, the length of each of the straps 112*a*-112*n* may be adjustable through a slip fastener or other type of adjustment. Each of the straps 112*a*-112*n* may be connected between the fabric portion 112 and one of the rings 114*a*-114*d*. The rings 114*a*-114*d* may be attached to the boat 104 with glue, similar to how the pivots 106*a*-106*n* are attached to the boat 104. For a metal or wooden boat 104, the rings 106*a*-106*n* may be screwed to the boat 104. In particular, the rings 114*a*-114*n* may be secured to a patch that may then be secured to the boat 104 (to be described in more detail in connection with FIG. 2).

The poles 108*a* and 108*b* may be positioned to create a gap between the first pivot 106*a* and the second pivot 106*b*. In particular, the pole 108*b* is shown positioned towards the back of the boat 104 while the pole 108*a* is shown positioned towards the front of the boat 104. The portion between the pivot 106*a* and the pivot 106*b* on one side and the pole 108*a* and the pole 108*b* on another side creates a gap. The fabric portion 110 may be formed to cover the gap and create the shade portion of the top 102. The fabric portion 110 may be made of a suitable boat top material. For example, a material with UV protection may be used. A material that may also be water repellant and/or mildew resistant may also be used.

Figure 2:
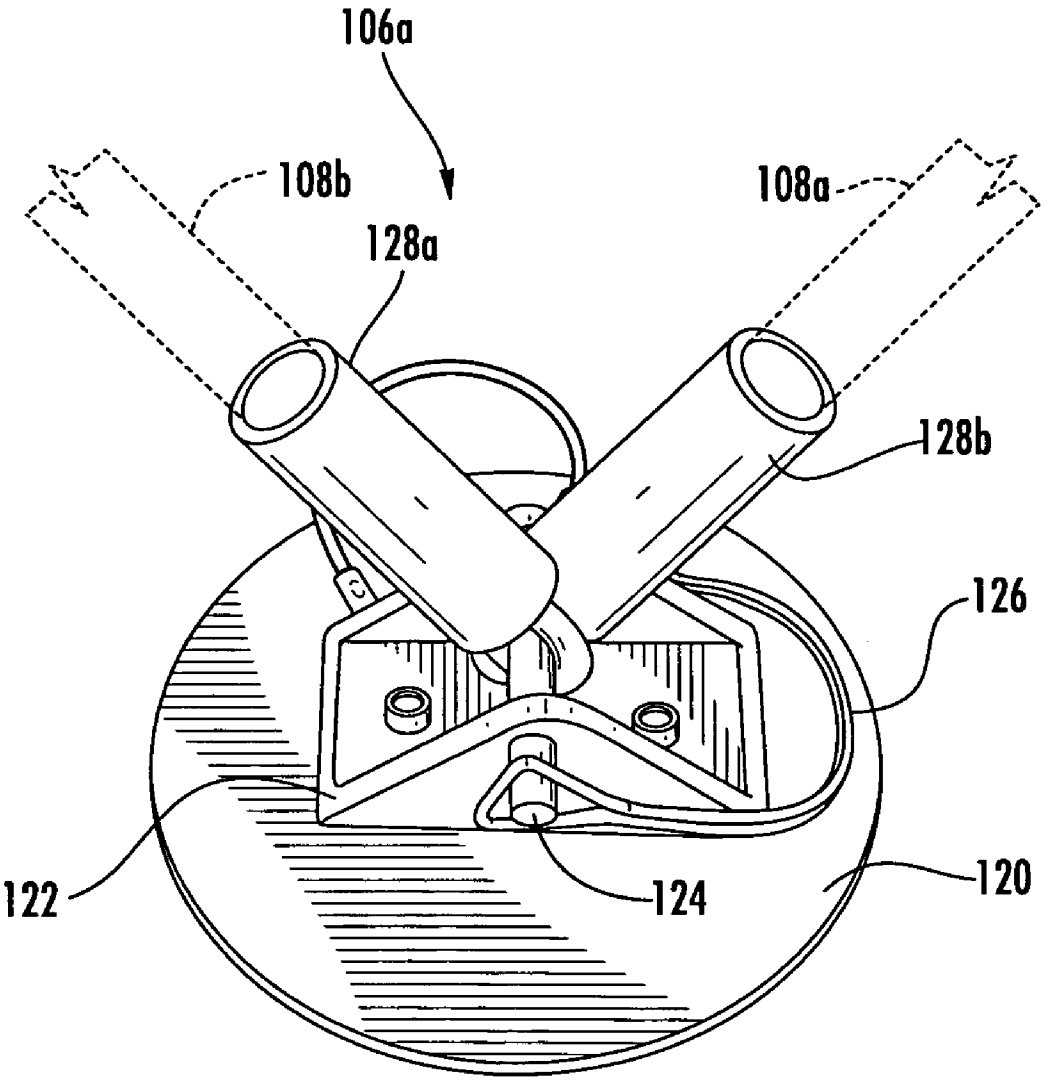
FIG. 2 is a perspective view of a pivot in accordance with the present invention.

Referring to FIG. 2, a more detailed diagram of the pivot 106*a* is shown. The pivot 106*a* generally comprises a mounting portion 120, a base portion 122, a pin 124, a securing portion 126, and a number of receptacles 128*a* and 128*b*. The mounting portion 120 may be a flexible material, such as rubber, or other appropriate material. The mounting portion 120 may be in the shape of a patch, and may be connected to an inflatable boat the way a patch would be connected to an inflatable boat. For example, inflatable boat repair glue may be used to secure the mounting portion 120. For example, a flexible glue, such as a one-part (or two part) glue may be used. The patch 120 may be screwed to frame of a non-inflatable boat 104.

The pole 108*a* and the pole 108*b* attach to a respective one of the receptacles 128*a* and 128*b*. The safety pin 124 securely holds the pole 108*a* and the pole 108*b* in place. The securing portion 126 may be used to secure the safety pin 124. The pivot 106*a* and the pivot 106*b* are normally positioned on the boat 102 in order to maximize sun protection. For example, the pivot 106*a* and the pivot 106*b* are normally positioned somewhere on the center portion of the boat 102.

Figure 3:
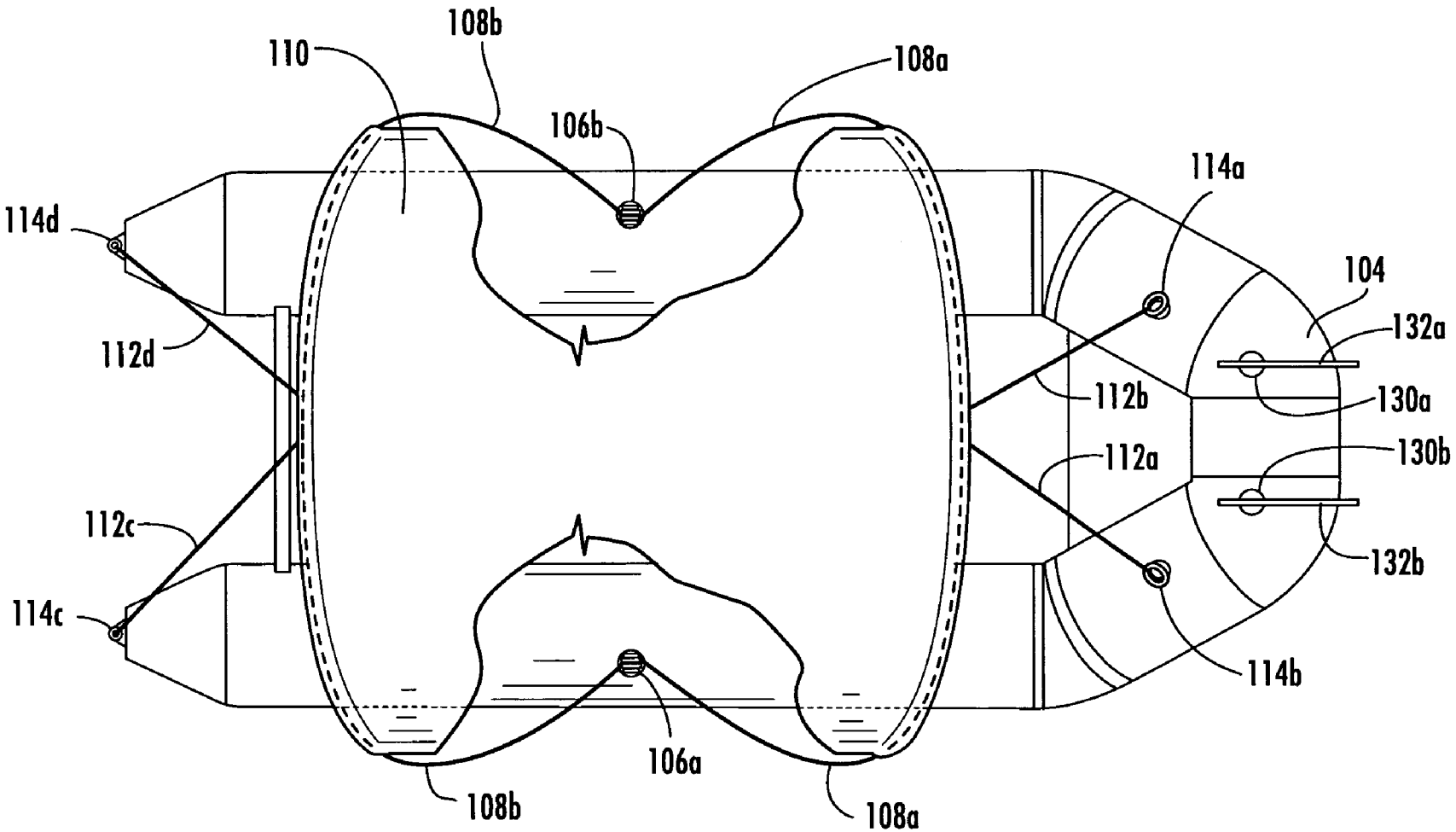
FIG. 3 is a top view showing the six points the top is secured to the boat.

Referring to FIG. 3, a top view of the system 100 is shown. FIG. 3 shows six attachment points (e.g., 106*a*, 114*a*, 114*b*, 114*c* and 114*d*). The attachment points are normally selected to provide maximum stability. For example, the ring 114*a* and the ring 114*b* are normally positioned in a generally V-shaped configuration around a connection point to the top 110. Similarly, the rings 114*c* and 114*d* are normally positioned in a generally V-shaped configuration on the opposite portion of the top. The poles 108*a* and 108*b* are shown extending down and attaching to the pivots 106*a* and 106*b*. The straps 112*a*-112*d* are shown extending down to the rings 114*a*-114*d*. The straps 112*a*-112*d* allow the top to be tightened for stiffness.

In one example, the side of the straps 112*a*-112*d* that are connected to the top 110 may have a looped end that surrounds the cavity sewn into the top 110. The looped end may allow the respective pole 108*a* or 108*b* to be inserted through the loop, providing additional support. The additional support may help reduce tearing of the top 110.

The system 100 may also include a portion 130*a* and a portion 130*b*. The sections 118*a*-118*b* may be secured to the boat 104 and may each include a respective strap 132*a*-132*b*. The straps 132*a* and 132*b* may be used to secure the top 102 when in a collapsed position. The straps 132*a* and 132*n* may be either tied off, or secured with Velcro™ or other fasteners.

The length of the pole 108*a* and the pole 108*b* may be selected to provide sufficient height to said top 110. For example, if a tall height is desired, the pole 108*a* and the pole 108*b* may be selected to be longer than if a shorter height was desired. In one example, the pole 108*a* and the pole 108*b* may be implemented in a number of shorter sections that are assembled to create the full length of either the pole 108*a* or the pole 108*b*. In such an arrangement, additional sections may be added to increase the length of the pole 108*a* or the pole 108*b*. Additionally, a string (or other type of wire, cord, etc.) may be added within a hollow portion of each section of the poles 108*a*-108*b* to aid in the assembly of the pole 108*a* or the pole 108*b*.

The sunshade system 100 may be assembled with a minimum effort. First, a user may secure the pivot pieces 106*a* and 106*b* to the boat 104. Next, a user may secure the rings 114*a*-114*n* to the boat 104. A user may then insert the pole 108*a* into a first channel of a fabric piece 110. The user may then insert the pole 108*b* into a second channel of the fabric piece 110. The user may then insert the pole 108*a* between the first pivot 106*a* and the second pivot 106*b*. The user may then insert the second pole 108*b* between the pivot 106*a* and the pivot 106*b*. The user may then install the strap 112*a* and the strap 112*b* between a near portion of the pole 108*a* and a respective one of the ring 114*a* and 114*b*. The user may then install the strap 112*c* and the strap 112*d* between a near center portion of the pole 108*b* and a respective one of the rings 114*c* and 114*d*. The straps 112*a*-112*n* may be tightened after being installed.

While the straps 114*a*-114*n* are normally installed at or near the center of the respective poles 108*a* and 108*b*, other configurations may be possible. For example, each strap 112*a*-112*d* may be installed at a different portion of the respective poles 108*a* and 108*b*. While a generally symmetrical configuration may be implemented, other non-symmetrical implementations may be implemented to meet particular design criteria.

Figure 4:
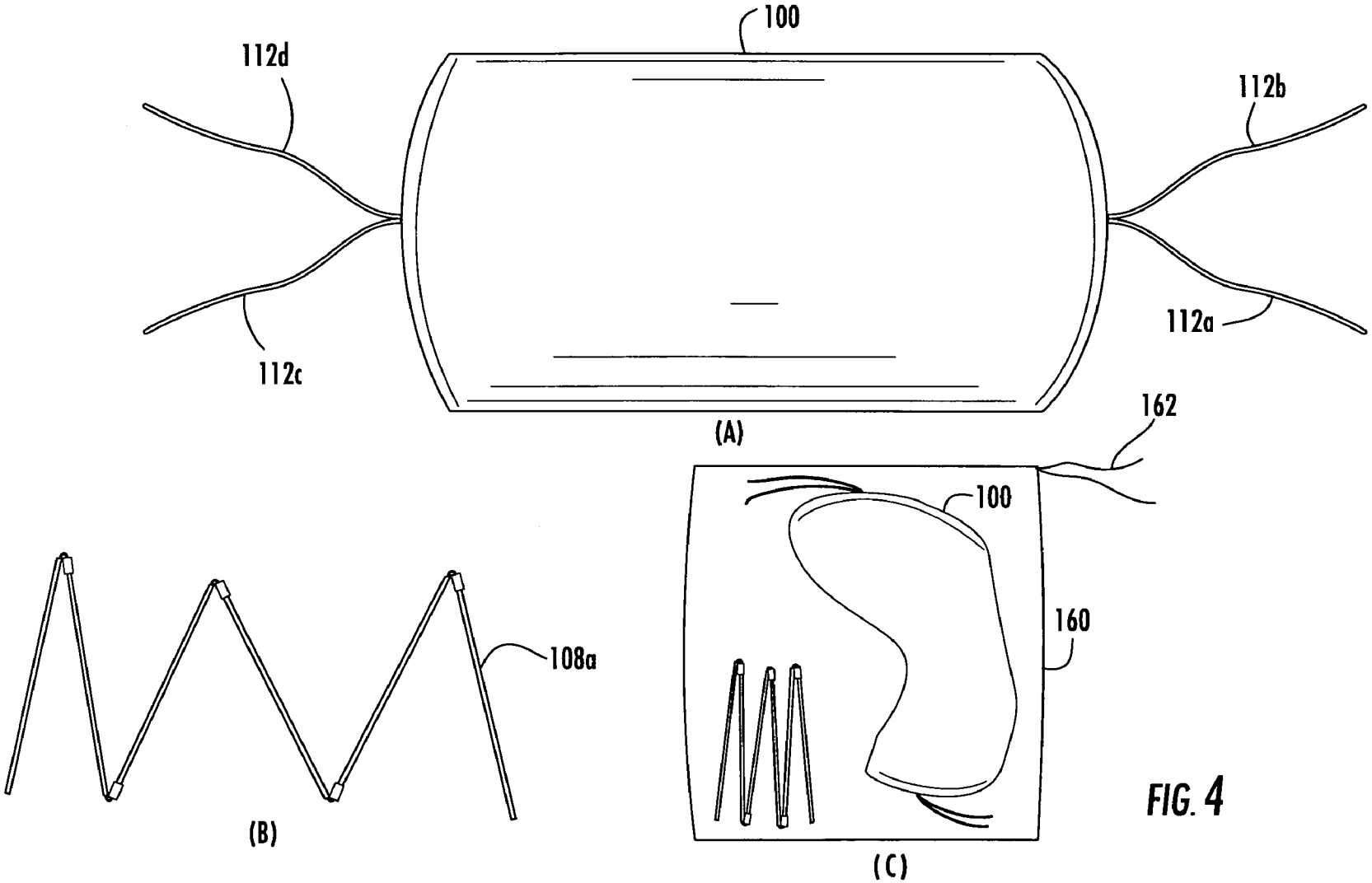
FIG. 4 illustrates the pieces that will fit into a bag.

Referring to FIGS. 4A-C, the top 110, the pole 108*a*, the adjustable straps 112*a*-112*d* and a bag 160 are shown. In one example, the bag 160 may be made of nylon. However, other flexible materials may be used. Materials that allow water or moisture to escape may also be used. Such materials avoid mildew or mode buildup when the top 102 is being stored. The bag 160 may have a string 162 that may be used to secure the bag 160.

Figure 5:
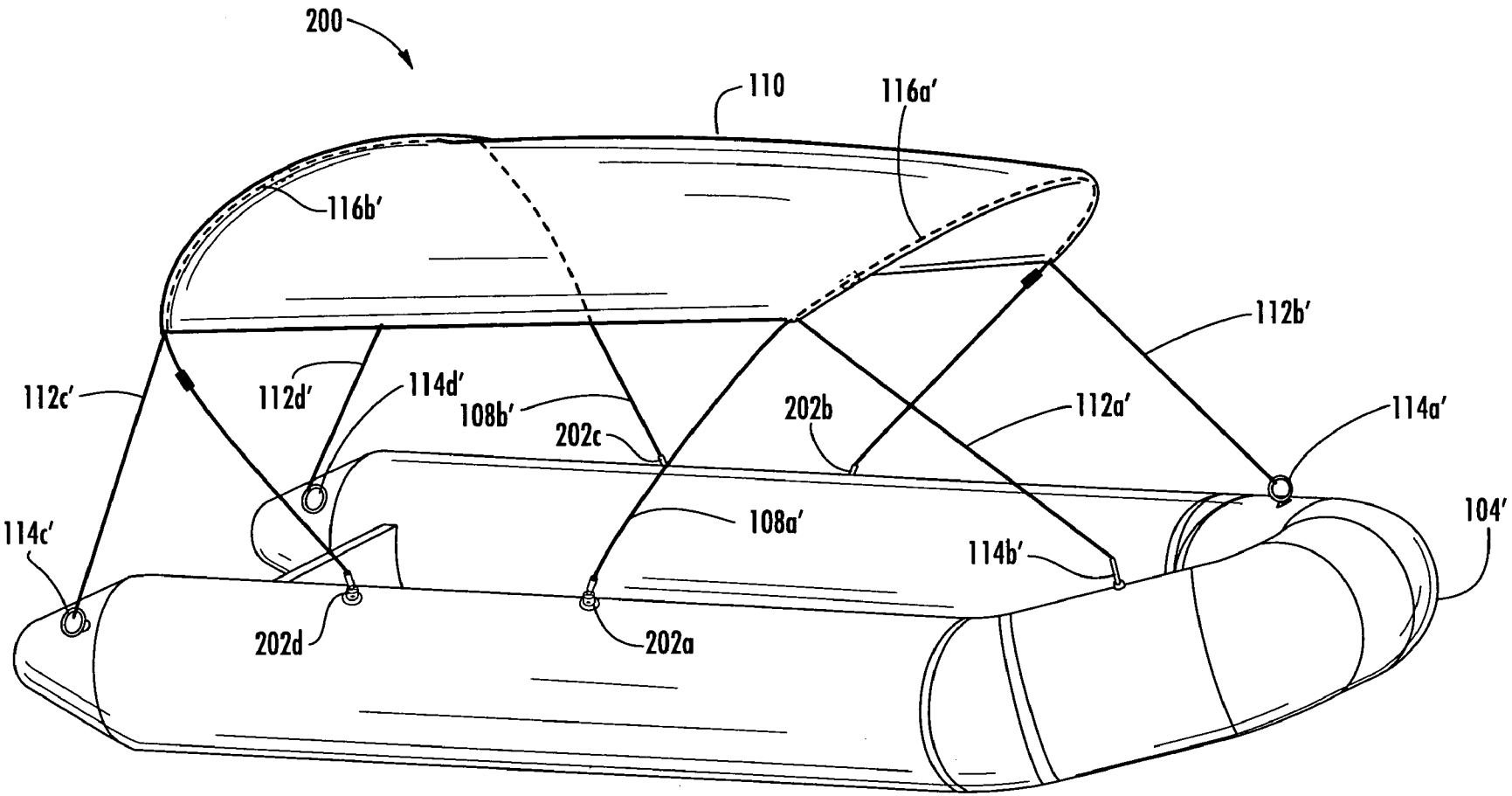
FIG. 5 is a diagram illustrating an alternate embodiment of the present invention.

Referring to FIG. 5, a system 200 is shown illustrating an alternate embodiment of the present invention. The system 200 normally connects a pole 108*a*' between a pivot 202*a* and a pivot 202*b*. A pole 108*b*' is normally connected between a pivot 202*c* and a pivot 202*d*. The pivots 202*a*-202*d* may each be configured to hold one end of one of the poles 108*a*' or 108*b*'. The pivot 202*a* and the pivot 202*b* may be secured to the boat 104' in different locations from each other. Similarity, the pivot 202*c* and the pivot 202*d* may be secured to the boat 104' in different locations from each other. By spacing the pivots 202*a*-*d*, a larger top portion 110' may be implemented.

Figure 6:
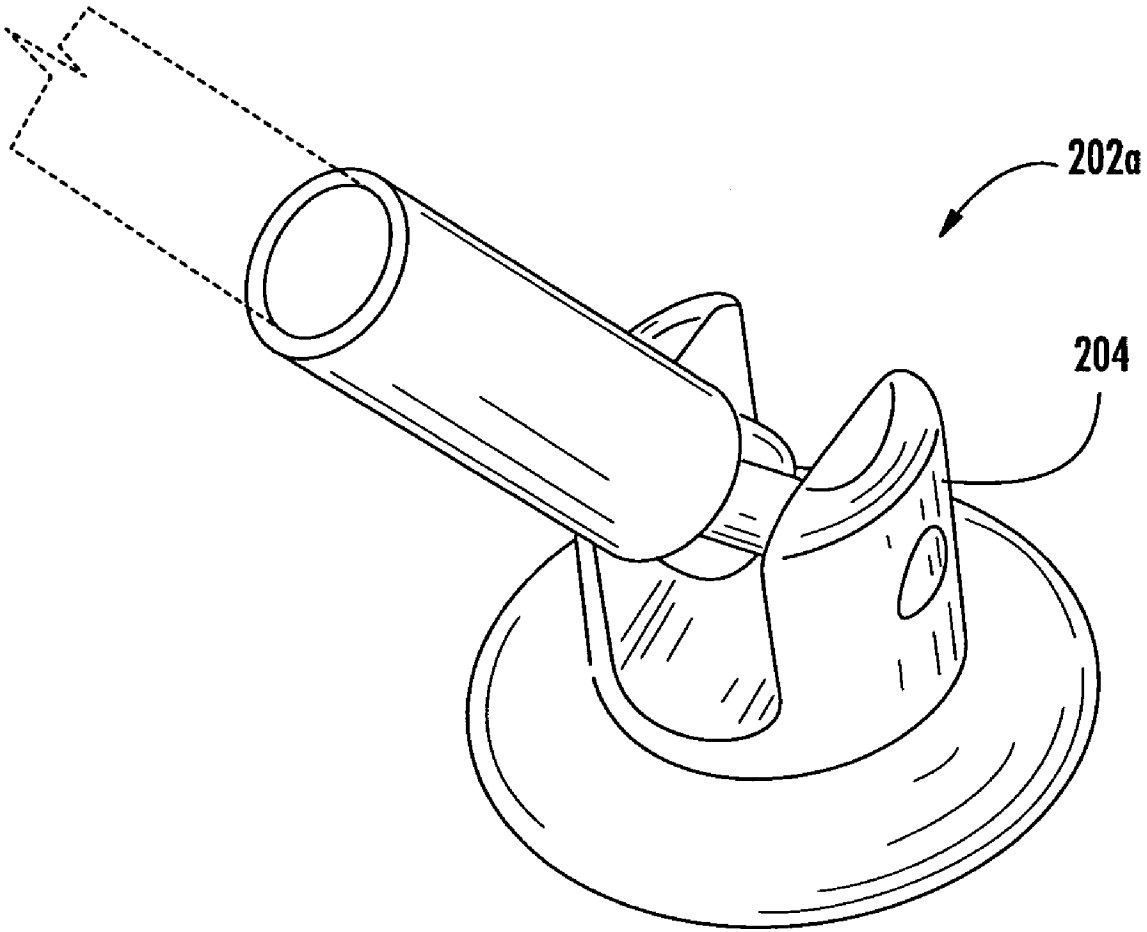
FIG. 6 is a diagram illustrating an alternate embodiment of the pivot.

Referring to FIG. 6, a more detailed diagram of the pivot 202*a* is shown. The pivot 202*a* may be secured to the boat in a similar manner as the pivots 106*a* and 106*b*. The pivot 202*a* may have a hole 204 that may be used to secure one end of one of the poles 108*a*' or 108*b*'. In order to provide a secure connection, the end of the pole 108*a*' or 108*b*' that is secured normally has a hole. A pin (not shown) may be used and may be positioned between the hole in the pole 108*a*' or 108*b*' and the hole 204.

Figure 7:
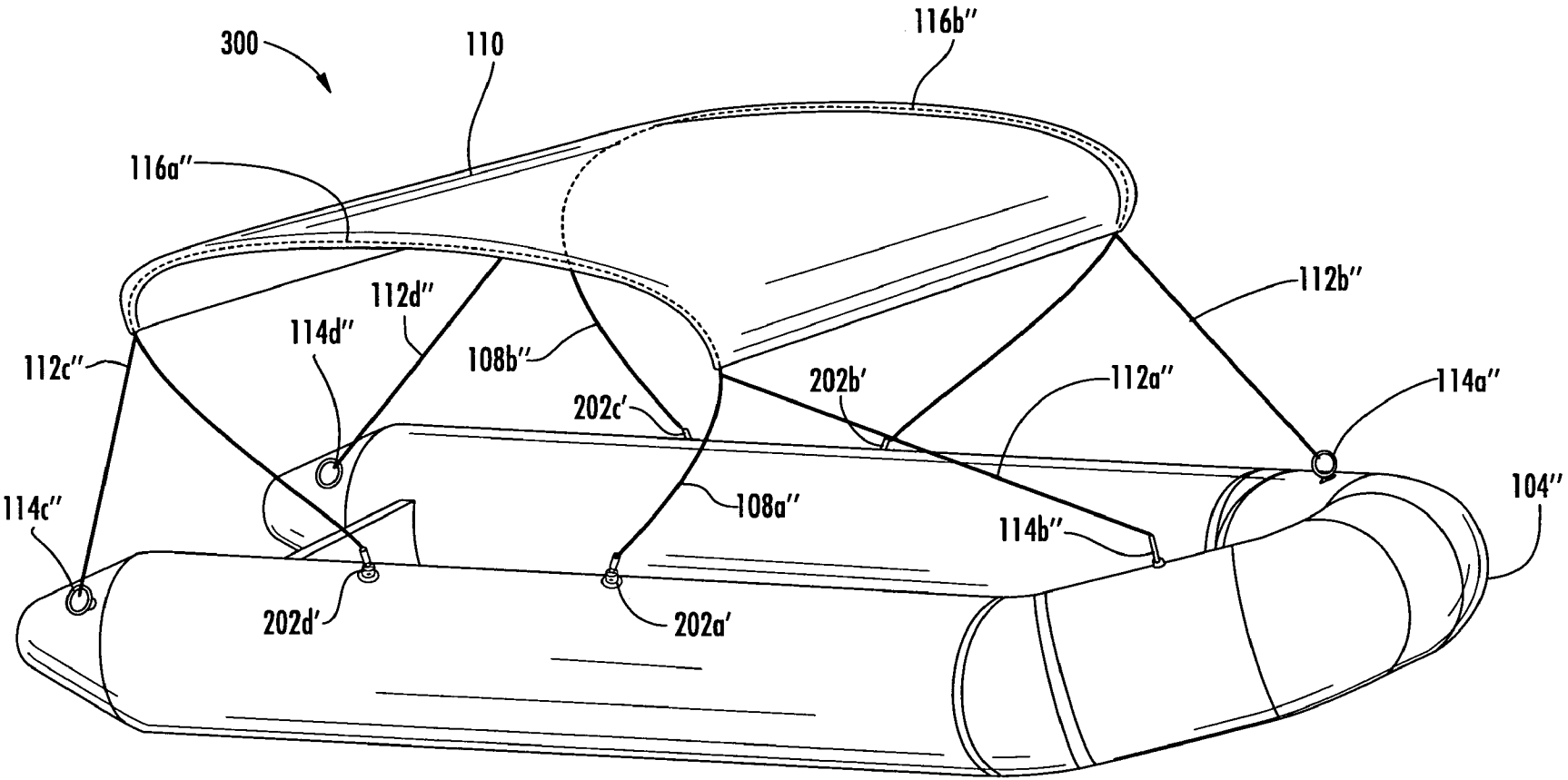
FIG. 7 is a diagram illustrating another alternate embodiment of the present invention.

Referring to FIG. 7, a system 300 illustrates another alternate embodiment of the present invention. The system 300 normally rotates the poles 108*a*" and 108*b*" 90 degrees with respect to the boat 104". By rotating the poles 108*a*" and 108*b*", an alternate configuration may be formed. The straps 112*a*"-112*d*" may be used to provide stability to the system 300.

While the invention has been particularly shown and described with reference to the preferred embodiments thereof, it will be understood by those skilled in the art that various changes in form and details may be made without departing from the spirit and scope of the invention.

The invention claimed is:

1. A method for installing a sunshade on a boat, comprising the steps of:

(A) securing a first and second pivot piece to said boat;

(B) securing a first ring, a second ring, a third ring, and a fourth ring to said boat;

(C) inserting a first pole into a first channel of a fabric piece;

(D) inserting a second pole into a second channel of said fabric piece;

(E) inserting said first pole between said first and said second pivot;

(F) inserting said second pole between said first and said second pivot;

(G) installing a first and a second strap between a center of said first pole and a respective one of said first and second ring; and (H) installing a third and a fourth strap between a center of said second pole and a respective one of said third and fourth rings.

2. The method according to claim 1, further comprising the step of:

tightening said first, second, third and fourth straps to support said fabric piece.

3. The method according to claim 1, wherein said first and second poles are flexible.

4. The method according to claim 1, wherein said first and second poles are flexible to create an arc.

5. The method according to claim 1, wherein said first and second pivot pieces allow a position of said fabric portion to be adjustable.

6. The method according to claim 1, wherein said first and second poles each include a connection portion configured to allow the connection of a strap.

7. The method according to claim 1, wherein said first pole, said second pole and said fabric portion are removable from said first pivot piece and said second pivot piece.

8. The method according to claim 1, wherein said first pole, said second pole and said fabric portion are collapsible.

9. The method according to claim 8, wherein said first pole, said second pole and said fabric portion are configured to be stored in a bag.

* * * * *